US009100998B2

(12) United States Patent
Yamamoto

(10) Patent No.: US 9,100,998 B2
(45) Date of Patent: Aug. 4, 2015

(54) LIGHT EMITTING APPARATUS, ELECTRONIC EQUIPMENT AND METHOD OF DRIVING PIXEL CIRCUIT THAT SUPPRESS LIGHT EMISSION

(71) Applicant: SEIKO EPSON CORPORATION, Tokyo (JP)

(72) Inventor: Gakuji Yamamoto, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 20 days.

(21) Appl. No.: 13/827,588

(22) Filed: Mar. 14, 2013

(65) Prior Publication Data

US 2013/0278167 A1 Oct. 24, 2013

Related U.S. Application Data

(63) Continuation of application No. 12/732,758, filed on Mar. 26, 2010, now Pat. No. 8,436,793.

(30) Foreign Application Priority Data

Apr. 1, 2009 (JP) ..... 2009-088866

(51) Int. Cl.
*G09G 3/30* (2006.01)
*H05B 37/02* (2006.01)
*G09G 3/32* (2006.01)

(52) U.S. Cl.
CPC ..... *H05B 37/02* (2013.01); *G09G 3/3233* (2013.01); *G09G 2300/0819* (2013.01); *G09G 2300/0842* (2013.01); *G09G 2310/0251* (2013.01);

(Continued)

(58) Field of Classification Search
CPC ..... G09G 3/30–3/3291
USPC ..... 345/36, 45, 76–81
See application file for complete search history.

(56) References Cited

U.S. PATENT DOCUMENTS 7,348,942 B2 3/2008 Jo
7,714,813 B2 5/2010 Uchino et al.

(Continued)

FOREIGN PATENT DOCUMENTS

JP A-2003-208127 7/2003
JP A-2004-252104 9/2004

(Continued)

OTHER PUBLICATIONS

Apr. 27, 2012 Office Action issued in U.S. Appl. No. 12/732,758.

(Continued)

*Primary Examiner* — Sanghyuk Park
(74) *Attorney, Agent, or Firm* — Oliff PLC

(57) ABSTRACT

A light emitting apparatus includes: a first transistor having a first end a second end, and a first control electrode; a light emitting device having a first electrode and a second electrode; a second transistor having a third end connected to the first end and a fourth end connected to the first electrode; a third transistor having a fifth end connected to the first electrode and a sixth end connected to an first power supply line; a fourth transistor having a seventh end connected to the first control electrode and a eighth end connected to the first end; a capacitive device which has a third electrode connected to first control electrode and a fourth electrode; and a fifth transistor having a ninth end connected to the fourth electrode and a tenth end connected to a data line.

20 Claims, 8 Drawing Sheets

(52) U.S. Cl.
CPC .. *G09G2310/0262* (2013.01); *G09G 2320/043* (2013.01); *G09G 2320/045* (2013.01)

(56) References Cited

U.S. PATENT DOCUMENTS

| | | | | |
|---|---|---|---|---|
| 2003/0103022 | A1 | 6/2003 | Noguchi et al. | |
| 2003/0151578 | A1* | 8/2003 | Morita | 345/89 |
| 2005/0237281 | A1 | 10/2005 | Tam | |
| 2007/0018917 | A1 | 1/2007 | Miyazawa | |
| 2007/0052644 | A1 | 3/2007 | Uchino et al. | |
| 2007/0273619 | A1 | 11/2007 | Kitazawa et al. | |
| 2008/0062092 | A1 | 3/2008 | Kanda | |
| 2008/0309653 | A1 | 12/2008 | Takahashi et al. | |
| 2010/0045650 | A1* | 2/2010 | Fish et al. | 345/211 |

FOREIGN PATENT DOCUMENTS

| | | |
|---|---|---|
| JP | A-2004-361640 | 12/2004 |
| JP | B2-4131227 | 6/2005 |
| JP | A-2008-032866 | 2/2008 |

OTHER PUBLICATIONS

Aug. 21, 2012 Office Action issued in U.S. Appl. No. 12/732,758.

* cited by examiner

LIGHT EMITTING APPARATUS, ELECTRONIC EQUIPMENT AND METHOD OF DRIVING PIXEL CIRCUIT THAT SUPPRESS LIGHT EMISSION

This is a Continuation of U.S. patent application Ser. No. 12/732,758 filed Mar. 26, 2010. The disclosure of the prior application is hereby incorporated by reference herein in its entirety.

BACKGROUND

1. Technical Field

The present invention relates to a light emitting apparatus, electronic equipment and a method of driving a pixel circuit.

2. Related Art

In recent years, an organic light emitting diode device (hereinafter, referred to as "OLED device") which is also referred to as an electroluminescent (EL) device or a light emitting polymer device attracts attention as a next-generation light emitting device alternative to a liquid crystal device. Gradation (typically, brightness) of the light emitting device of this type changes when an electric current is supplied to the light emitting device. A configuration in which the current is controlled by a driving transistor has been proposed hitherto.

A pixel circuit of the light emitting apparatus disclosed in Japanese Patent No. 4,131,227 includes a light emission control transistor between the driving transistor and the OLED device. Further, the pixel circuit disclosed in Japanese Patent No. 4,131,227 includes a switching transistor between a node and a constant potential line. In this case, the node is provided between the light emission control transistor and the light emitting device on a driving current path. With this configuration, a current can be prevent from being supplied to the OLED device at the non-lighting time by turning the light emission control transistor in an OFF-state. In addition, faint light emission due to a leakage current of the light emission control transistor is prevented by turning the switching transistor in an ON-state. Therefore, so-called "black floating" phenomenon can be suppressed.

In the light emitting apparatus disclosed in Japanese Patent No. 4,131,227, when writing of a data potential is completed, the switching transistor is set to be in an OFF-state while the light emission control transistor is set to be in an ON state. At this time, a timing at which the switching transistor is turned to be in the OFF-state is substantially the same as a timing at which the light emission control transistor is turned to be in the ON-state. Therefore, charges left in a node between the driving transistor and the light emission control transistor when the writing of a data potential is completed are flown into the OLED device at the start of a light emission period. This causes a problem that undesired light emission is instantaneously caused. Note that the undesired light emission is different from intended light emission occurred when the driving current is supplied.

SUMMARY

An advantage of some aspects of the invention is to suppress light emission of a light emitting device due to charges left on a node between a driving transistor and a light emission control transistor.

A light emitting apparatus according to an aspect of the invention includes a pixel circuit and a driving circuit which drives the pixel circuit. In the light emitting device, the pixel circuit includes a driving transistor which generates a driving current, a light emitting device of which gradation is determined depending on the driving current, a light emission control transistor which is disposed between the driving transistor and the light emitting device, a discharge transistor which is arranged between a node between the light emission control transistor and the light emitting device and an electric supply line, a capacitor device which has a first electrode connected to a gate of the driving transistor and a second electrode, and a first switching device which is interposed between the gate and a drain of the driving transistor. Further, in the light emitting device, the driving circuit sets the light emission control transistor to be in an OFF-state while setting the first switching device to be in an ON-state so as to make a voltage between the gate and the source of the driving transistor be asymptotic to a threshold voltage in a compensation period, the driving circuit sets the first switching device to be in the OFF-state so as to set a potential of the gate of the driving transistor to be a potential corresponding to specified gradation of the light emitting device in a writing period after the compensation period, the driving circuit sets the light emission control transistor and the discharge transistor to be in the ON-state so as to flow a current through a path leading to the electric supply line through the light emission control transistor and the discharge transistor in a discharge period after the compensation period, and the driving circuit sets the discharge transistor to be in the OFF-state while setting the light emission control transistor to be in the ON-state so as to supply the driving current to the light emitting device in a light emission period after the discharge period.

According to the configuration, in the discharge period provided immediately before the light emission period, the light emission control transistor and the discharge transistor are set to be in the ON-state. Therefore, charges left between the driving transistor and the light emission control transistor when the writing of the data potential is completed can be sufficiently removed. Accordingly, an advantage that light emission of the light emitting device due to the charges left between the driving transistor and the light emission control transistor can be suppressed is obtained.

In the light emitting device according to the aspect of the invention, the driving circuit sets the light emission control transistor, the discharge transistor and the first switching device to be in the ON-state so as to initialize the driving circuit in an initialization period before the compensation period. With this configuration, charges left in the capacitor device are flown to the electric supply line through the first switching device, the light emission control transistor, and the discharge transistor. That is to say, the charges left in the capacitor device before the writing of the data potential can be discharged.

In the light emitting device according to the aspect of the invention, the pixel circuit is arranged between a first power supply line to which a first potential is supplied and a second power supply line to which a second potential lower than the first potential is supplied, and a potential supplied to the electric supply line is set such that a potential of the node in the discharge period is lower than a potential which is higher than the second potential by a threshold voltage of the light emitting device.

With this configuration, charges accumulated in the node due to the compensation operation and the writing of the data potential, for example, are discharged to the electric supply line through the discharge transistor. That is to say, there is an advantage that the charges left in the node between the driving transistor and the light emission control transistor can be surely removed before the light emission period is started.

In the light emitting device according to the aspect of the invention, the pixel circuit includes a second switching device interposed between a data line to which a data potential corresponding to the specified gradation is supplied and the second electrode. Further, in the light emitting device, the driving circuit includes a control signal generation circuit which generates a control signal controlling ON- and OFF-states of the second switching device, and a processing circuit which inverts and delays the generated control signal. In addition, ON- and OFF-states of the light emission control transistor is controlled by a signal output from the processing circuit.

With this configuration, since a circuit for generating a control signal controlling the ON- and OFF-states of the light emission control transistor needs not be separately provided, the configuration thereof can be simplified. For example, when a plurality of pixel circuits are arranged in a matrix form, a signal controlling ON- and OFF-states of the second switching devices and the light emission control transistors in the pixel circuits of each row is generally generated by using a shift register. With the above configuration, a signal controlling the ON- and OFF-states of the light emission control transistor is generated by inverting and delaying the control signal controlling ON- and OFF-states of the second switching device. Therefore, an advantage that a shift register for generating a signal controlling the ON- and OFF states of the light emission control transistor needs not be separately provided is obtained.

Electrical equipment according to another aspect of the invention includes the above light emitting apparatus. As examples of the electrical equipment include a personal computer, a portable phone, and an electronic camera, or the like.

Further, the aspect of the invention may be considered as a method of driving a pixel circuit. In the method of driving a pixel circuit according to still another aspect, the driving method of the pixel circuit includes a driving transistor which generates a driving current, a light emitting device of which gradation is determined depending on the driving current, a light emission control transistor which is arranged between the driving transistor and the light emitting device, a discharge transistor which is arranged between a node between the light emission control transistor and the light emitting device and an electric supply line, a capacitor device which has a first electrode and a second electrode connected to a gate of the driving transistor, and a first switching device which is interposed between the gate and a drain of the driving transistor. The method of driving the pixel circuit preferably includes setting the light emission control transistor to be in an OFF-state while setting the first switching device to be in an ON-state so as to make a voltage between the gate and a source of the driving transistor be asymptotic to a threshold voltage in a compensation period, setting the first switching device to be in the OFF-state so as to set a potential of the gate of the driving transistor to be a potential corresponding to specified gradation of the light emitting device in a writing period after the compensation period, setting the light emission control transistor and the discharge transistor to be in the ON-state so as to flow a current through a path leading to the electric supply line through the light emission control transistor and the discharge transistor in a discharge period after the compensation period, and setting the discharge transistor to be in the OFF-state while setting the light emission control transistor to be in the ON-state so as to supply the driving current to the light emitting device in a light emission period after the discharge period.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: Configuration of Light Emitting Apparatus

Figure 1:
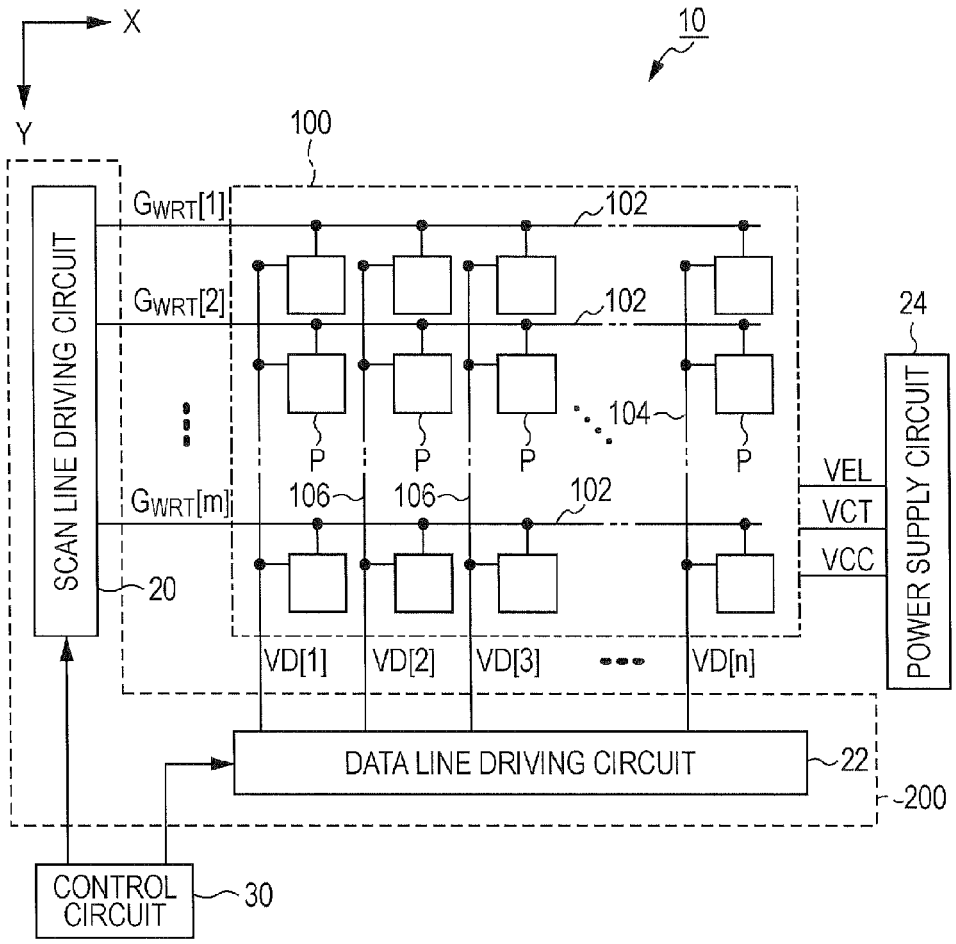
FIG. 1 is a block diagram illustrating a configuration of a light emitting apparatus according to an embodiment of the invention.

FIG. 1 is a block diagram illustrating a configuration of a light emitting apparatus 10 according to the embodiment of the invention. The light emitting apparatus 10 is an apparatus employed in various types of electronic equipment as a unit for displaying an image. The light emitting apparatus 10 includes a pixel array portion 100 in which a plurality of pixel circuits P are arranged in a planar form, a driving circuit 200 which drives each pixel circuit P, a power supply circuit 24 which generates various types of potentials used in the light emitting apparatus 10 and a control circuit 30.

Figure 2:
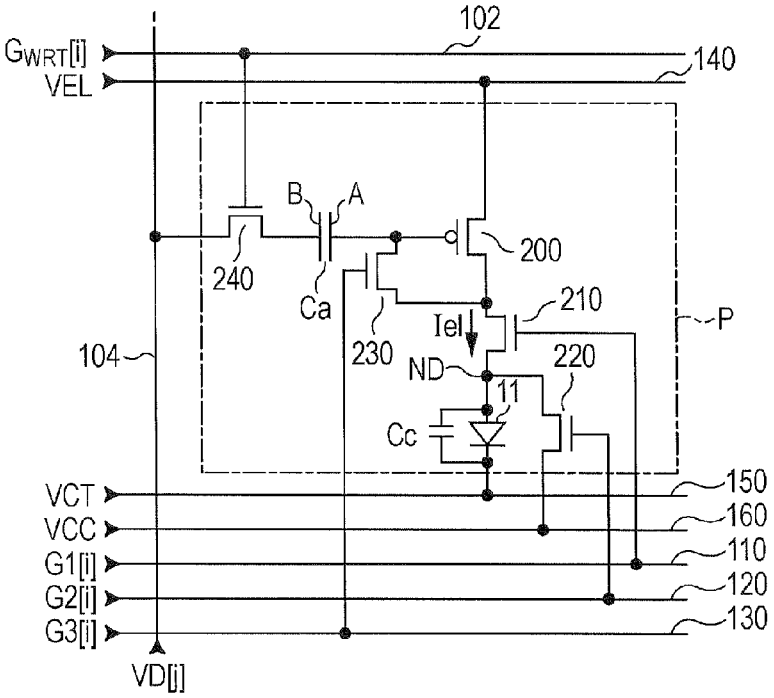
FIG. 2 is a circuit diagram illustrating a configuration of a pixel circuit according to the embodiment of the invention.

As shown in FIG. 1, m scan lines 102 extending in the X direction and n data lines 104 extending in the Y direction perpendicular to the X direction are provided on the pixel array portion 100 (m and n are natural numbers). Each pixel circuit P is disposed at a position corresponding to each intersection of the scan line 102 and the data line 104. Accordingly, the pixel circuits P are arranged in a matrix form of vertical m rows and horizontal n columns. As shown in FIG. 2, a first control line 110, a second control line 120 and a third control line 130 are extended in the X direction for each row so as to be in parallel with the scan lines 102, in the embodiment of the invention.

The driving circuit 200 as shown in FIG. 1 includes a scan line driving circuit 20 and a data line driving circuit 22. The scan line driving circuit 20 selects one scan line 102 every horizontal scanning period and supplies a control signal in synchronization with the selection to the first control line 110, the second control line 120 and the third control line 130 as shown in FIG. 2. For simplification of the explanation, a scan signal supplied to the scan line 102 of ith row (i is an integer of $1 \leq i \leq m$) is expressed by $G_{WRT}$ [i]. A first control signal supplied to the first control line 110 of the ith row is expressed by G1[*i*], a second control signal supplied to the second control line 120 of the ith row is expressed by G2[*i*], a third control signal supplied to the third control line 130 of the ith row is expressed by G3[*i*].

The data line driving circuit 22 as shown in FIG. 1 generates data potentials VD[1] to VD[n] corresponding to each of the n pixel circuits for one row. At this time, the one row corresponds to the scan line 102 selected by the scan line driving circuit 20 in each horizontal scanning period. Then, the data line driving circuit 22 outputs the generated data potentials VD[1] to VD[n] to each data line 104. A data potential VD[j] output to the data line 104 of jth column (j is an integer of $1 \leq j \leq n$) in the horizontal scanning period at which the ith row is selected is a potential corresponding to gradation specified for the pixel circuit P positioned at the ith row and the jth column.

The power supply circuit 24 as shown in FIG. 1 generates a potential VEL at a high order side of a power supply, a potential VCT at a low order side thereof, and a potential VCC. The potential VEL is commonly supplied to each pixel circuit P through a first power supply line 140 as shown in FIG. 2. Similarly, the potential VCT is supplied to each pixel circuit P through a second power supply line 150 as shown in FIG. 2. Further, the potential VCC is supplied to each pixel circuit P through a third power supply line 160 as shown in FIG. 2.

The control circuit 30 as shown in FIG. 1 supplies clock signals (not shown) or the like to each of the scan line driving circuit 20 and the data line driving circuit 22 so as to control these circuits. In addition, the control circuit 30 supplies image data defining the gradation of each pixel circuit P in the pixel array portion 100 for each frame to the data line driving circuit 22.

Next, a configuration of each pixel circuit P is described with reference to FIG. 2. Although only one pixel circuit P located at the ith row and the jth column is illustrated in FIG. 2, each of other pixel circuits P has the same configuration. As shown in FIG. 2, the pixel circuit P is disposed between the first power supply line 140 and the second power supply line 150. The pixel circuit P has a P-channel driving transistor 200, an N-channel light emission control transistor 210, an N-channel discharge transistor 220, a capacitor device Ca, an N-channel first switching device 230, an N-channel second switching device 240 and an OLED device 11. A capacitance Cc as shown in FIG. 2 is a parasitic capacitance intrinsic to the OLED device 11. The OLED device 11 is a light emitting device in which a light emitting layer made of an organic EL material is interposed between the anode and cathode thereof.

As shown in FIG. 2, the driving transistor 200 and the light emission control transistor 210 are arranged on a current path leading to the OLED device 11 from the first power supply line 140. The driving transistor 200 is a unit for generating a driving current Iel in accordance with a gate potential. A source of the driving transistor 200 is connected to the first power supply 140 and a drain thereof is connected to a drain of the light emission control transistor 210.

The light emission control transistor 210 is a unit which determines whether or not the driving current Iel is to be supplied to the OLED device 11. A source of the light emission control transistor 210 is connected to an anode of the OLED device 11 and a gate of the light emission control transistor 210 is connected to the first control line 110.

The second power supply line 150 is connected to a cathode of the OLED device 11. A drain of the discharge transistor 220 is connected to a node ND between the light emission control transistor 210 and the light emitting device 11 on the path of the driving current Iel. A source of the discharge transistor 220 is connected to the third power supply line 160 and a gate of the discharge transistor 220 is connected to the second control line 120. A potential VCC supplied to the third power supply line 160 is set such that a potential of the node ND when the discharge transistor 220 is in the ON-state is lower than a potential which is higher than the potential VCT supplied to the second power supply line 150 by a threshold voltage of the light emitting device 11.

The first switching device 230 is disposed between a gate and a drain of the driving transistor 200. A gate of the first switching device 230 is connected to the third control line 130.

The capacitor device Ca is a unit for retaining a potential of the gate of the driving transistor 200. The capacitor device Ca has a first electrode A and a second electrode B. The first electrode A is connected to the gate of the driving transistor 200. The second switching device 240 is interposed between the second electrode B and the data line 104. A gate of the second switching device 240 is connected to the scan line 102.

Figure 3:
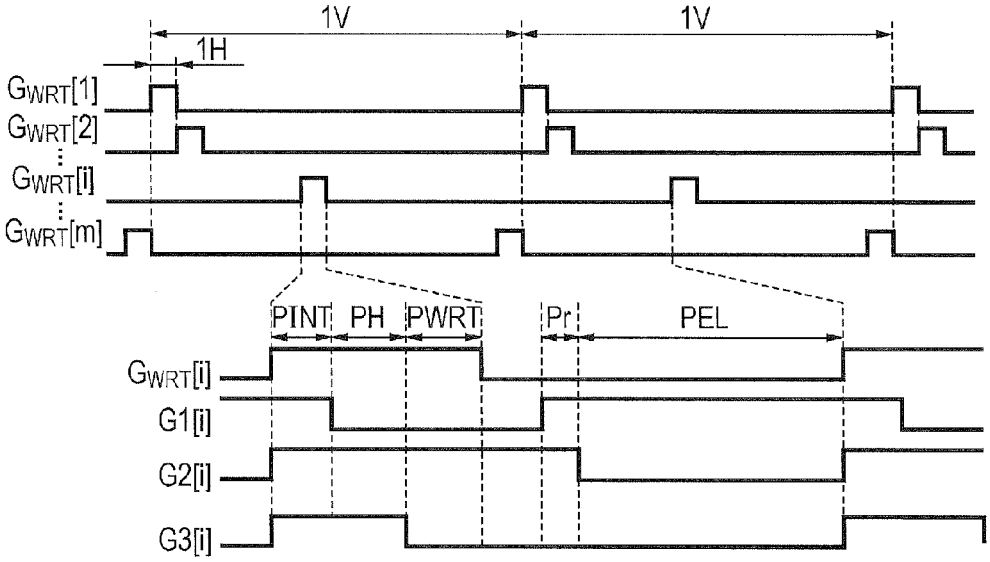
FIG. 3 is a diagram illustrating specific waveforms of signals output from a scan line driving circuit.

Subsequently, specific waveforms of each signal generated by the scan line driving circuit 20 is described with reference to FIG. 3. As shown in FIG. 3, levels of scan signals $G_{WRT}$[1] to $G_{WRT}$[m] sequentially become high in this order every time a horizontal scanning period (1H) passes. That is to say, the scan signal $G_{WRT}$[i] keeps a high level in the ith horizontal scanning period while keeping a low level in periods other than the ith horizontal scanning period during the vertical scanning period (1V). A transition of the level of the scan signal $G_{WRT}$[i] to the high level means that each pixel circuit P of the ith row is selected. In FIG. 3, a case where a rising edge of the scan signal $G_{WRT}$[i] and a trailing edge of the subsequent scan signal $G_{WRT}$[i+1] are the same is illustrated. However, the trailing time of the subsequent scan signal $G_{WRT}$ [i+1] may be at a time where a predetermined time has passed since the rising time of the scan signal $G_{WRT}$[i].

As shown in FIG. 3, an initialization period PINT, a compensation period PH, a writing period PWRT are assigned to one horizontal scanning period 1H. When a discharge period Pr is terminated after the writing period PWRT, a light emission period PEL starts.

In the initialization period PINT, the scan line driving circuit 20 sets the first control signal G1[*i*], the second control signal G2[*i*] and the third control signal G3[*i*] to a high level.

In the compensation period PH, the scan line driving circuit 20 sets the first control signal G1[*i*] to a low level while keeping other signals in a state of the initialization period PINT.

In the writing period PWRT[i], the scan line driving circuit 20 sets the third control signal G3[*i*] to a low level while keeping other signals in a state of the compensation period PH.

In the discharge period Pr, the scan line driving circuit 20 sets the scan signal $G_{WRT}$[i] to a low level and sets the second control signal G2[*i*] to a high level. The scan line driving circuit 20 keeps other signals in a state of the writing period PWRT.

Figure 4:
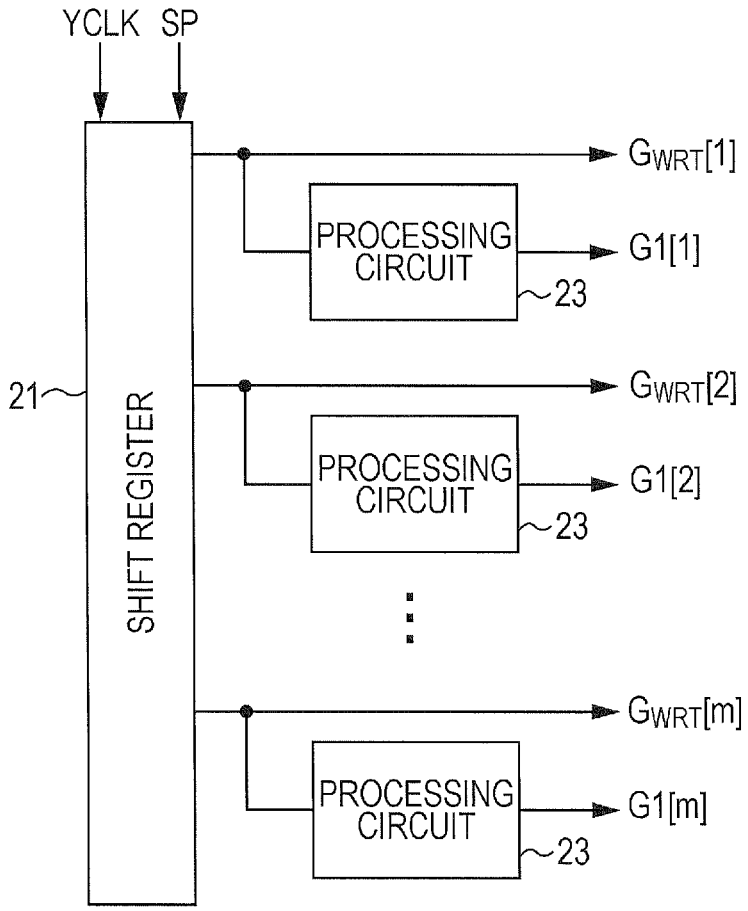
FIG. 4 is a diagram illustrating a configuration of a part of the scan line driving circuit.

As is understood from FIG. 3, the first control signal G1[*i*] has a waveform obtained by inverting and delaying a waveform of the scan signal $G_{WRT}$[i]. So, the first control signal G1[*i*] is generated from the scan signal $G_{WRT}$[i] in the embodiment of the invention. FIG. 4 is a diagram illustrating a portion of the scan line driving circuit 20 where the scan signal $G_{WRT}$[i] and the first control signal G1[*i*] are generated. As shown in FIG. 4, the portion of the scan line driving circuit 20 where the scan signal $G_{WRT}$[i] and the first control signal G1[*i*] are generated includes a shift register 21 and m processing circuits 23. A start pulse SP and a clock signal YCLK which are output from a control circuit (not shown) are supplied to the shift register 21. The shift register 21 sequentially transfers the start pulse SP in accordance with the clock signal YOLK so as to generate the scan signals $G_{WRT}$[1] to $G_{WRT}$[m]. Each of m processing circuits 23 is provided so as to correspond to each of m rows. Although a processing circuit 23 of ith row is described, each of the processing circuits 23 of other rows has the same configuration.

Figure 5:
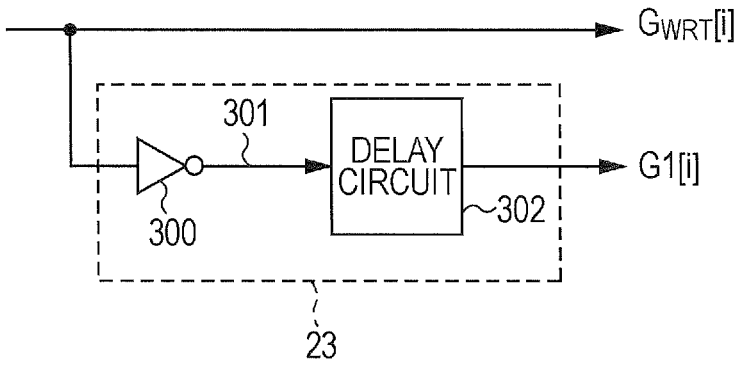
FIG. 5 is a diagram illustrating a processing circuit in detail.
Figure 6:
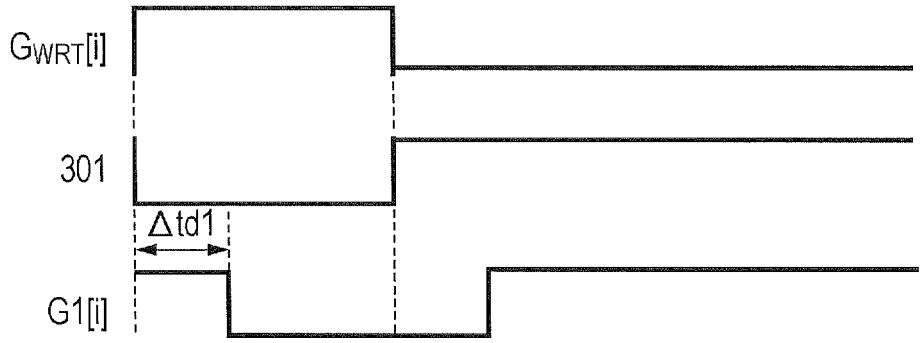
FIG. 6 is a diagram illustrating specific waveforms of signals output from the processing circuit.

Each processing circuit 23 is a unit for inverting and delaying the scan signal $G_{WRT}$[i]. As shown in FIG. 5, each of the processing circuits 23 includes an inverter 300 and a delay circuit 302. The scan signal $G_{WRT}$[i] output from the shift register 21 is input to the inverter 300. The inverter 300 inverts a logical level of the input scan signal $G_{WRT}$[i] so as to output the inverted signal 301 to the delay circuit 302 as shown in FIGS. 5 and 6. The delay circuit 302 delays the inverted signal 301 by a time length Δtd1 so as to generate the first control signal G1[*i*] as shown in FIG. 6.

According to the embodiment of the invention, since a shift register for generating the first control signal G1[*i*] needs not be separately provided, a space on a substrate for mounting the scan line driving circuit 20 can be reduced in comparison with a configuration where the shift register for generating the first control signal G1[*i*] is separately provided. Further, not only so-called a frame (a portion not contributing to display) can be smaller but the number of circuits can be reduced. Therefore, there is an advantage that a yield ratio can be improved.

B. Operation of Light Emitting Apparatus

Next, specific operations of the pixel circuits P are described with reference to FIGS. 7 to 11. As described below, an operation of the pixel circuit P at the ith row and the jth column is described by dividing into the initialization period PINT, the compensation period PH, the writing period PWRT, the discharge period Pr and the light emission period PEL.

(a) Initialization Period PINT

Figure 7:
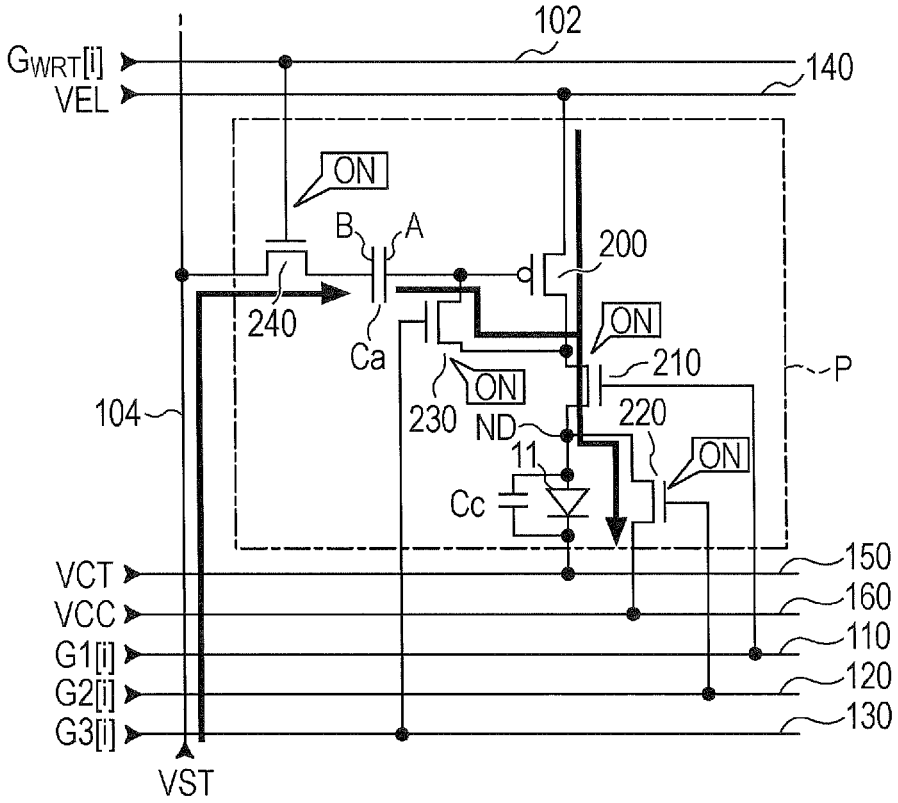
FIG. 7 is a circuit diagram for explaining an operation of the pixel circuit in an initialization period.

FIG. 7 illustrates a specific operation of the pixel circuit P in the initialization period PINT. As shown in FIG. 7, all of the light emission control transistor 210, the discharge transistor 220, the first switching device 230, and the second switching device 240 are in the ON sate in the initialization period PINT. In this case, the first electrode A of the capacitor device Ca is conducted to the third power supply line 160 through the first switching device 230, the light emission control transistor 210, the discharge transistor 220. Therefore, a potential of the first electrode A is set to VCC. That is to say, a potential of the gate of the driving transistor 200 is also set (initialized) to VCC. The second electrode B of the capacitor device Ca is conducted to the data line 104 through the second switching device 240. Therefore, a potential of the second electrode B is set to a predetermined potential supplied to the data line 104. At this time, the predetermined potential supplied to the data line 104 is expressed by VST.

(b) Compensation Period PH

Figure 8:
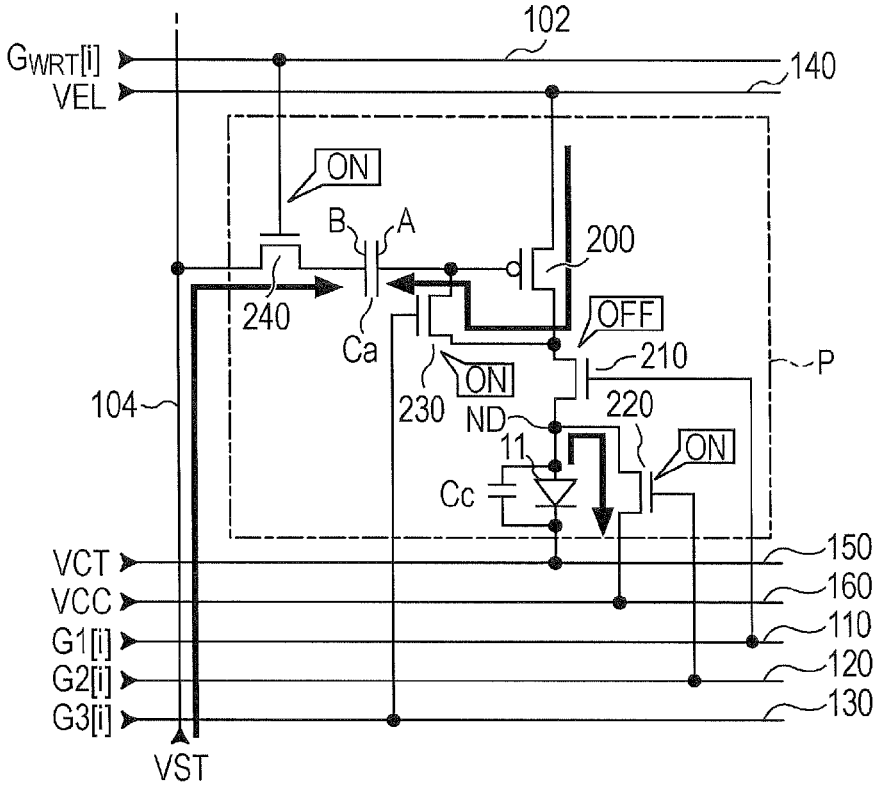
FIG. 8 is a circuit diagram for explaining an operation of the pixel circuit in a compensation period.

FIG. 8 illustrates a specific operation of the pixel circuit P in the compensation period PH. In the compensation period PH, a compensation operation of a threshold voltage of the driving transistor 200 is performed. In the compensation period PH, the light emission control transistor 210 is set to be in the OFF-state while the discharge transistor 220, the first switching device 230 and the second switching device 240 are set to be in the ON-state, as shown in FIG. 8. At this time, the driving transistor 200 is in a state of diode connection. If a threshold voltage of the driving transistor 200 is assumed to be Vth, a voltage between the gate and the source of the driving transistor 200 is asymptotic to "VEL−Vth".

(C) Writing Period PWRT

Figure 9:
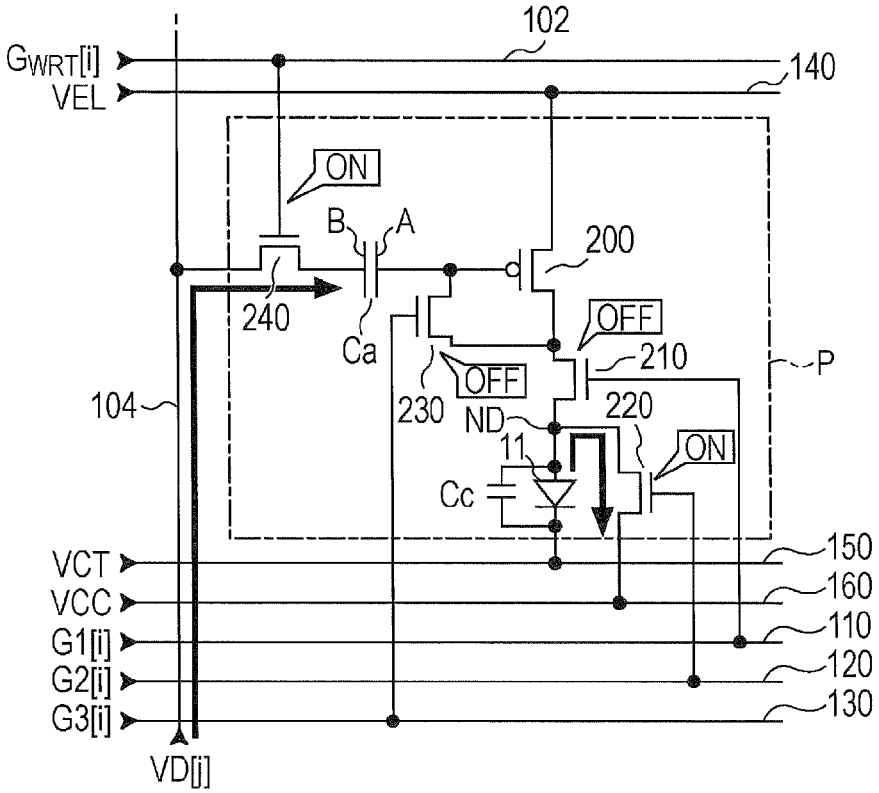
FIG. 9 is a circuit diagram for explaining an operation of the pixel circuit in a writing period.

FIG. 9 illustrates a specific operation of the pixel circuit P in the writing period PWRT. In the writing period PWRT, the light emission control transistor 210 and the first switching device 230 are set to be in the OFF-state while the discharge transistor 220 and the second switching device 240 are set to be in the ON-state, as shown in FIG. 9. At this time, a data potential VD[j] in accordance with a specified gradation of the light emitting device 11 in the pixel circuit P at the ith row and the jth column is supplied to the data line 104. Accordingly, a potential of the second electrode B of the capacitor device Ca changes to VD[j] from VST.

As shown in FIG. 9, since the first switching device 230 shifts to be in the OFF-state, the gate of the driving transistor 200 becomes in an electrically floating state. Accordingly, if the potential of the second electrode B varies from the potential VST in the compensation period PH to the data potential VD[j] by a variation amount ΔV (=VST−VD[j]), the potential of the first electrode A (the potential of the gate of the driving transistor 200) varies from the last potential (VEL−Vth) due to a capacitance coupling. In this case, a variation amount of the potential of the first electrode A is determined depending on a capacitance ratio of the capacitor device Ca to other parasitic capacitances (for example, a gate capacitance of the driving transistor 200 or a capacitance parasite to the other interconnections). To be more specific, a capacitance value of the capacitor device Ca is assumed to be "C", and a capacitance value of the parasitic capacitances is assumed to be "Cs". At this time, a variation amount of the potential of the first electrode A is expressed by "ΔV·C/(C+CS)". Therefore, the potential of the gate of the driving transistor 200 in the writing period PWRT is stable at a level expressed by the following equation (1).

$$VG = VEL - V\text{th} - k \times \Delta V \quad (1)$$

In the equation (1), VG indicates the potential of the gate of the driving transistor 200. In addition, k in the equation (1) is C/(C+CS).

(d) Discharge Period Pr

Figure 10:
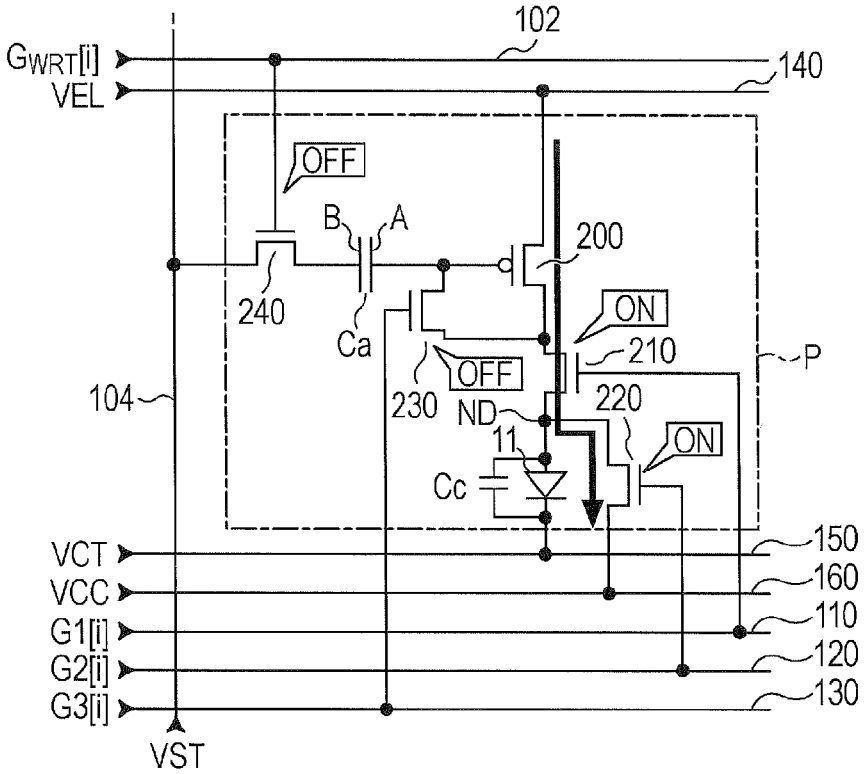
FIG. 10 is a circuit diagram for explaining an operation of the pixel circuit in a discharge period.

FIG. 10 illustrates a specific operation of the pixel circuit P in the discharge period Pr. In the discharge period Pr, the light emission control transistor 210 and the discharge transistor 220 are set to be in the ON-state while the first switching device 230 and the second switching device 240 are set to be in the OFF-state, as shown in FIG. 10. Therefore, a current path is formed from the first power supply line 140 to the third power supply line 160 through the driving transistor 200, the light emission control transistor 210 and the discharge transistor 220 as shown in FIG. 10. As described above, the potential VCC is set such that a potential of the node ND when the discharge transistor 220 is in the ON-state is lower than a potential which is higher than the potential VCT supplied to the second power supply line 150 by the threshold voltage of the light emitting device 11. Accordingly, the current flowing through the driving transistor 200 and the light emission control transistor 210 flows into not the light emitting device 11 but the third power supply line 160 through the discharge transistor which is in the ON-state. Charges accumulated between the drain of the driving transistor 200 and the drain of the light emission control transistor 210 due to the operations of the pixel circuit P in the above compensation period PH and the writing period PWRT are discharged to the third power supply line 160 through the discharge transistor 220.

(e) Light Emission Period PEL

Figure 11:
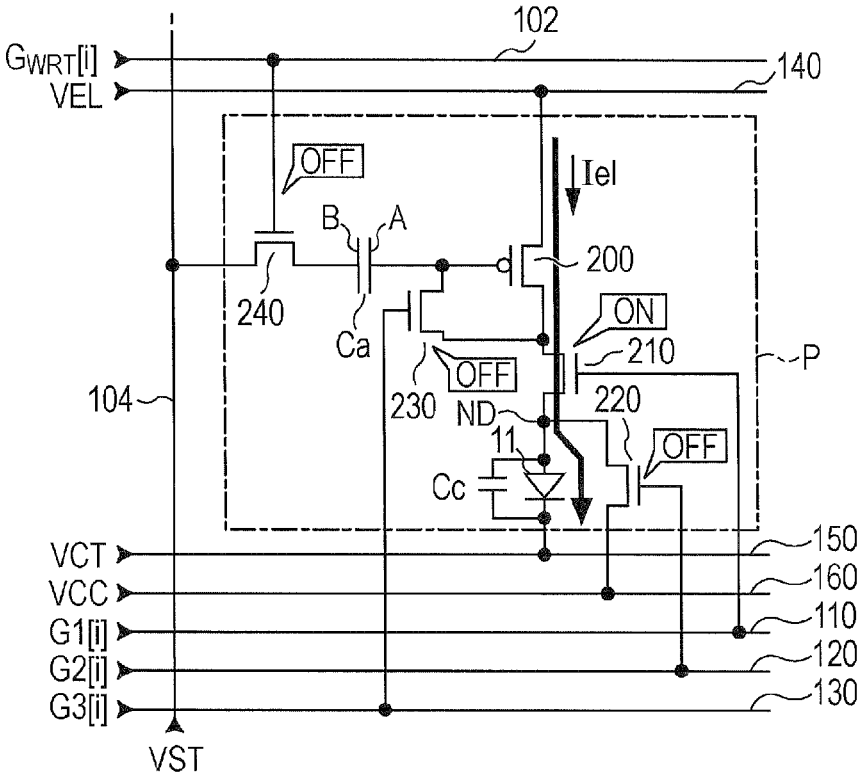
FIG. 11 is a circuit diagram for explaining an operation of the pixel circuit in a light emission period.

FIG. 11 illustrates a specific operation of the pixel circuit P in the light emission period PEL. In the light emission period PEL, the light emission control transistor 210 is set to be in the ON-state while the discharge transistor 220, the first switching device 230 and the second switching device 240 are set to be in the OFF-state, as shown in FIG. 11. At this time, the driving current Iel generated in the driving transistor 200 is supplied to the OLED device 11 through the light emission control transistor 210. Then, the OLED device 11 emits light at a brightness level in accordance with the data potential VD[j].

In the light emission period PEL, the driving current Iel flowing into the light emitting device 11 is expressed by the following equation (2). It is noted that "β" is a gain coefficient of the driving transistor 200 and "Vgs" is a voltage between the gate and the source of the driving transistor 200.

$$Ie1 = (\beta/2)(Vgs - Vth)^2 \quad (2)$$
$$= (\beta/2)(VEL - VG - Vth)^2$$

When the equation (1) is substituted to the equation (2), the equation (2) is changed as follows.

$$Ie1 = (\beta/2)\{VEL - (VEL - Vth - k \times \Delta V) - Vth\}^2$$
$$= (\beta/2)(k \times \Delta V)^2$$

This equation indicates that the driving current Iel supplied to the light emitting device 11 is determined by a differential value ΔV between the data potential VD[j] and the potential VST (ΔV=VST−VD[j]) and not depending on the threshold voltage Vth of the driving transistor 200.

As described above, charges accumulated between the drain of the driving transistor 200 and the drain of the light emission control transistor 210 due to the previously performed compensation operation and writing of the data potential VD can be discharged to the third power supply ling 160 in the embodiment of the invention as follows. That is, the discharge is executed by setting the light emission control transistor 210 and the discharge transistor 220 to be in the ON-state simultaneously in the discharge period Pr immediately before the light emission period PEL. Accordingly, the charges left between the drain of the driving transistor 200 and the drain of the light emission control transistor 210 when the writing of the data potential VD is completed are flown into the OLED device 11 immediately after the light emission period PEL is started. This makes it possible to suppress undesired light emission from instantaneous occurring. Note that the undesired light emission is different from intended light emission occurred when the driving current Iel is supplied.

In the embodiment of the invention, the time length of the discharge period Pr is set to a degree that the charges accumulated between the drain of the driving transistor 200 and the drain of the light emission control transistor 210 can be sufficiently removed. This makes it possible to more effectively suppress the undesired light emission, which is different from intended light emission occurred when the driving current Iel is supplied, from instantaneous occurring immediately after the light emission period PEL is started.

Further, in the embodiment of the invention, a value of the potential VCC is set such that the potential of the node ND when the discharge transistor 220 is in the ON-state is lower than a potential which is higher than the potential VCT by the threshold voltage of the light emitting device 11. However, the potential VCC can be also set such that the potential of the node ND when the discharge transistor 220 is in the ON-state is lower than the potential VCT, for example. As described above, the discharge transistor 220 is set to be in the ON-state in the compensation period PH and the writing period PWRT. The potential of the node ND at these times is lower than the potential VCT so that the charges left in the parasitic capacitance Cc intrinsic to the capacitor device 11 can be discharged to the third power supply line 160.

C: Modification

The invention is not limited to the embodiments of the invention described above and the following modifications can be made, for example. Further, two or more modifications among the following modifications can be combined.

(1) Modification 1

Figure 12:
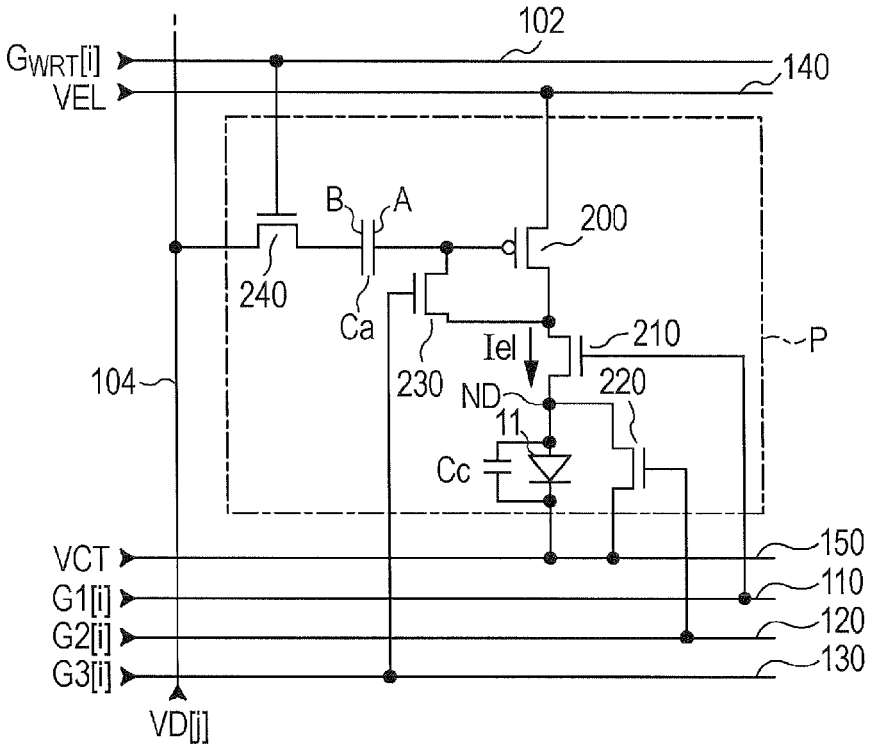
FIG. 12 is a circuit diagram illustrating a configuration of a pixel circuit according to a modification of the invention.

As shown in FIG. 12, the third power supply line 160 can be eliminated. In a configuration shown in FIG. 12, the source of the discharge transistor 220 is connected to the second power supply line 150. The configuration shown in FIG. 12 has an advantage that the number of the power supply lines can be reduced in comparison with that in the above embodiment of the invention. However, it is to be noted that the potential of the node ND when the discharge transistor 220 is in the ON-state is lower than a potential which is higher than the potential VCT by the threshold voltage of the light emitting device 11 in the configuration shown in FIG. 12.

(2) Modification 2

Although the discharge transistor 220 is an N-channel type in the above embodiment of the invention, the discharge transistor 220 is not limited thereto and may be a P-channel type. However, according to a mode in which the discharge transistor 220 is configured as the N-channel type, the potential supplied to the gate of the discharge transistor 220 when the discharge transistor 220 is in the ON-state can be lower in comparison with a mode in which the discharge transistor 220 is configured as the P-channel type. Accordingly, there is an advantage that when the discharge transistor 220 is in the OFF-state, an amount of leakage current generated on the discharge transistor 220 can be reduced.

(3) Modification 3

Figure 13:
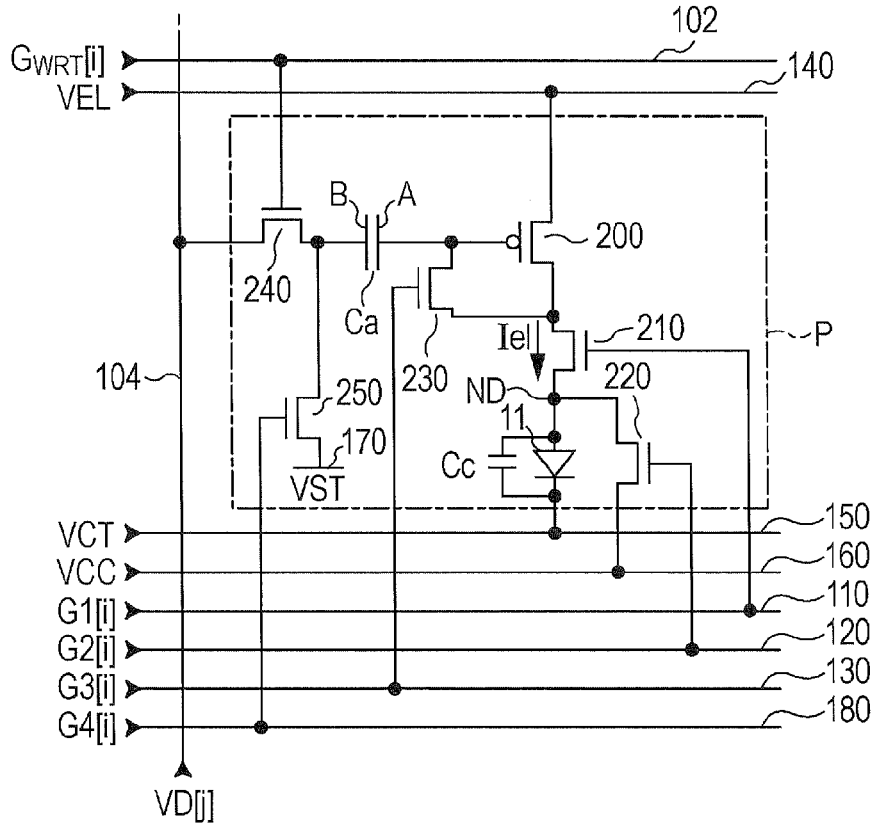
FIG. 13 is a circuit diagram illustrating a configuration of a pixel circuit according to another modification of the invention.

As shown in FIG. 13, a third switching device 250 may be provided between a fourth power supply line to which the potential VST is supplied and the second electrode B. A gate of the third switching device 250 is connected to a fourth control line 180 to which a fourth control signal G4[*i*] is supplied. In a mode shown in FIG. 13, the scan line driving circuit 20 sets the scan signal $G_{WRT}$[i] to high level only in the writing period PWRT, and sets the scan signal $G_{WRT}$[i] to low level in the initialization period PINT and the compensation period PH. On the other hand, the scan line driving circuit 20 sets the fourth control signal G4[*i*] to high level in the initialization period PINT and the compensation period PH, and sets the fourth control signal G4[*i*] to low level in other periods. Accordingly, the third switching device 250 is set to be in the ON-state in the initialization period PINT and the compensation period PH so that the second electrode B is conducted to the fourth power supply line 170 through the third switching device 250. Therefore, the potential of the second electrode B is set to the potential VST in the initialization period PINT and the compensation period PH.

(4) Modification 4

The inverter 300 is provided at a previous stage of the delay circuit 302 in each processing circuit 23 according to the above embodiment of the invention. However, a configuration is not limited thereto and a mode in which the delay circuit 302 is provided at a previous stage of the inverter 300 may be employed. In short, it is sufficient that each processing circuit 23 is a unit which inverts and delays the scan signal $G_{WRT}[i]$.

(5) Modification 5

The OLED device is employed as an example of the light emitting device in the above embodiment of the invention. However, an inorganic light emitting diode or a light emitting diode (LED) may be employed. In short, any devices may be employed as the light emitting device as long as the device emits light at a brightness level in accordance with the driving current.

D: Application Example

Figure 14:
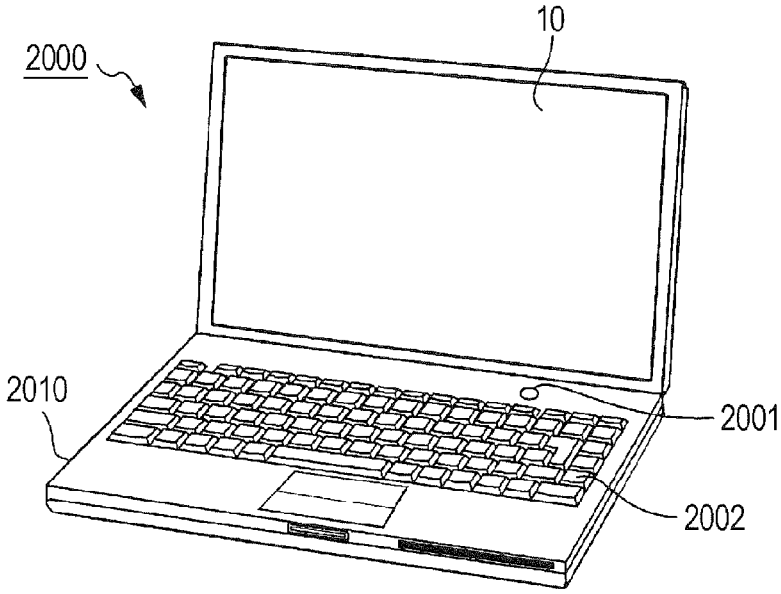
FIG. 14 is a perspective view illustrating a specific form of electronic equipment according to the invention.

Next, electronic equipment using the light emitting apparatus according to the invention is described. FIG. 14 is a perspective view illustrating a configuration of a mobile type personal computer in which the light emitting apparatus 10 according to the embodiment of the invention as described above is employed as a display device. The personal computer 2000 includes the light emitting apparatus 10 as a display device and a main body portion 2010. A power supply switch 2001 and a keyboard 2002 is provided on the main body portion 2010. The light emitting apparatus 10 employs the OLED device so that a user-friendly screen of which view angle is large can be displayed.

Figure 15:
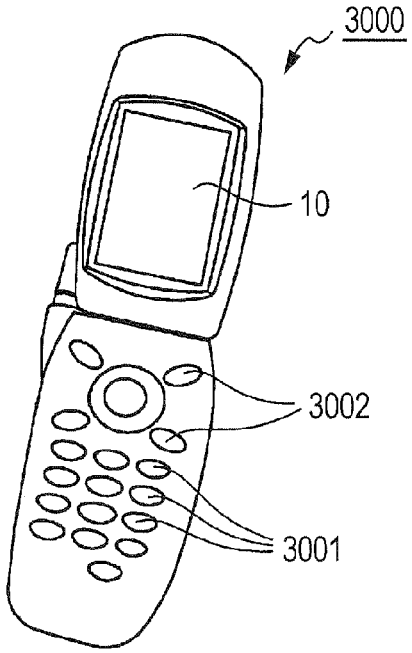
FIG. 15 is a perspective view illustrating another specific form of electronic equipment according to the invention.

FIG. 15 illustrates a configuration of a mobile phone to which the light emitting apparatus 10 according to the embodiment of the invention is applied. The mobile phone 3000 includes a plurality of operation buttons 3001 and scroll buttons 3002 and the light emitting apparatus 10 as a display device. A screen displayed on the light emitting apparatus 10 is scrolled by operating the scroll buttons 3002.

Figure 16:
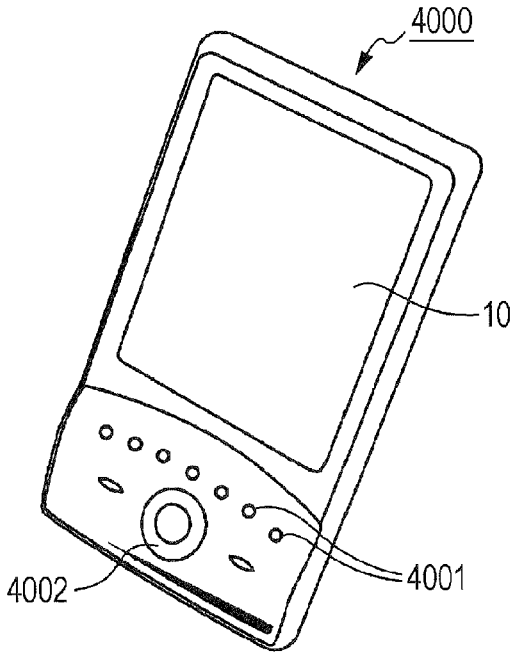
FIG. 16 is a perspective view illustrating still another specific form of electronic equipment according to the invention.

FIG. 16 illustrates a configuration of a personal digital assistant (PDA) to which the light emitting apparatus 10 according to the embodiment of the invention is applied. The PDA 4000 includes a plurality of operation buttons 4001, a power supply switch 4002 and the light emitting apparatus 10 as a display device. Various pieces of information such as an address list and a schedule book are displayed on the electrooptic apparatus D by operating the power supply switch 4002.

The electronic equipment to which the electrooptic apparatus according to the embodiment of the invention includes a digital still camera, a television, a video camera, a car navigation system, a pager, an electronic organizer, an electronic paper, a calculator, a word processor, a workstation, a videophone, a POS terminal, a printer, a scanner, a copying machine, a video player, equipment including a touch panel, and the like in addition to the pieces of electronic equipment as shown in FIGS. 14 to 16.

The entire disclosure of Japanese Application No. 2009-088866 is incorporated by reference.

What is claimed is:

1. An OLED apparatus comprising:

a first transistor having a first end and a second end, and a first control electrode;

an organic light emitting diode having a first electrode and a second electrode;

a second transistor having a third end directly connected to the first end of the first transistor and a fourth end directly connected to the first electrode of the organic light emitting diode;

a third transistor having a fifth end directly connected to the first electrode of the organic light emitting diode and a sixth end directly connected to a first power supply line, wherein the first power supply line is different from a data line;

a fourth transistor having a seventh end directly connected to the first control electrode of the first transistor and a eighth end directly connected to the first end of the first transistor;

a capacitive device which has a third electrode directly connected to the first control electrode of the first transistor and a fourth electrode; and a fifth transistor having a ninth end directly connected to the fourth electrode of the capacitive device and a tenth end directly connected to the data line, wherein the eighth end of the fourth transistor is connected to the fifth end of the third transistor through the second transistor; and wherein the third transistor is continuously turned on during an initialization period, a compensation period, a writing period and a discharge period, but is turned off during a light emission period.

2. The OLED apparatus according to claim 1, further comprising a sixth transistor having a eleventh end directly connected to the fourth electrode of the capacitive device and a twelfth end directly connected to a second power supply line.

3. Electronic equipment including the OLED apparatus according to claim 2.

4. The OLED apparatus according to claim 1, further comprising a third power supply line directly connected to the second electrode of the organic light emitting diode, a first potential being supplied to the third power supply line.

5. The OLED apparatus according to claim 4, the first transistor being a P-channel type transistor.

6. The OLED apparatus according to claim 5, further comprising a fourth power supply line directly connected to the second end of the first transistor, a second potential higher than the first potential being supplied to the fourth power supply line.

7. Electronic equipment including the OLED apparatus according to claim 6.

8. Electronic equipment including the OLED apparatus according to claim 5.

9. The OLED apparatus according to claim 4, a third potential of the first power supply line being lower than a potential which is higher than the first potential by a threshold voltage of the organic light emitting diode.

10. Electronic equipment including the OLED apparatus according to claim 9.

11. Electronic equipment including the OLED apparatus according to claim 4.

12. The OLED apparatus according to claim 1, the second electrode of the organic light emitting diode being directly connected to the first power supply line.

13. Electronic equipment including the OLED apparatus according to claim 12.

14. The OLED apparatus according to claim 1, the fourth transistor and the fifth transistor being the same conduction type transistor.

15. Electronic equipment including the OLED apparatus according to claim 14.

16. Electronic equipment including the OLED apparatus according to claim 1.

17. An OLED apparatus comprising a pixel circuit and a driving circuit which drives the pixel circuit, wherein the pixel circuit includes:

a first transistor having a first end and a second end, and a first control electrode;

an organic light emitting diode having a first electrode and a second electrode;

a second transistor having a third end directly connected to the first end of the first transistor and a fourth end directly connected to the first electrode of the organic light emitting diode;

a third transistor having a fifth end directly connected to the first electrode of the organic light emitting diode and a sixth end directly connected to a first power supply line, wherein the first power supply line is different from a data line;

a fourth transistor having a seventh end directly connected to the first control electrode of the first transistor and a eighth end directly connected to the first end of the first transistor;

a capacitive device which has a third electrode directly connected to the first control electrode of the first transistor and a fourth electrode; and a fifth transistor having a ninth end directly connected to the fourth electrode of the capacitive device and a tenth end directly connected to the data line, wherein the eighth end of the fourth transistor is connected to the fifth end of the third transistor through the second transistor; and wherein the third transistor is continuously turned on during an initialization period, a compensation period, a writing period and a discharge period, but is turned off during a light emission period.

18. Electronic equipment including the OLED apparatus according to claim 17.

19. An OLED apparatus comprising:

a first transistor having a first end and a second end, and a first control electrode;

an organic light emitting diode having a first electrode and a second electrode;

a second transistor electrically connected between the first end of the first transistor and the first electrode of the organic light emitting diode;

a third transistor electrically connected between the first electrode of the organic light emitting diode and a first power supply line, wherein the first power supply line is different from a data line;

a fourth transistor electrically connected between the first control electrode of the first transistor and the first end of the first transistor;

a capacitive device which has a third electrode connected to the first control electrode of the first transistor and a fourth electrode; and a fifth transistor electrically connected between the fourth electrode of the capacitive device and the data line, the first electrode of the organic light emitting diode being directly connected to the second transistor and the third transistor, wherein the fourth transistor is connected to the third transistor through the second transistor; and wherein the third transistor is continuously turned on during an initialization period, a compensation period, a writing period and a discharge period, but is turned off during a light emission period.

20. Electronic equipment including the OLED apparatus according to claim 19.

* * * * *